US011193416B2

(12) United States Patent
Quix et al.

(10) Patent No.: US 11,193,416 B2
(45) Date of Patent: Dec. 7, 2021

(54) METHODS AND SYSTEMS FOR A PISTON

(71) Applicant: Ford Global Technologies, LLC, Dearborn, MI (US)

(72) Inventors: Hans Guenter Quix, Herzogenrath (DE); David van Bebber, Aachen (DE); Antonio Farina, Übach-Palenberg (DE); Herbert Ernst, Kerkrade (NL); Richard Fritsche, Wermelskirchen (DE)

(73) Assignee: Ford Global Technologies, LLC, Dearborn, MI (US)

( * ) Notice: Subject to any disclaimer, the term of this patent is extended or adjusted under 35 U.S.C. 154(b) by 9 days.

(21) Appl. No.: 16/450,803

(22) Filed: Jun. 24, 2019

(65) Prior Publication Data

US 2019/0390597 A1 Dec. 26, 2019

(30) Foreign Application Priority Data

Jun. 25, 2018 (DE) ..... 102018210265.1

(51) Int. Cl.

| | |
|---|---|
| ***F02B 75/04*** | (2006.01) |
| ***F02D 15/02*** | (2006.01) |
| ***F02F 3/22*** | (2006.01) |
| ***F02F 3/00*** | (2006.01) |

(52) U.S. Cl.

CPC ..... *F02B 75/044* (2013.01); *F02D 15/02* (2013.01); *F02F 3/0015* (2013.01); *F02F 3/22* (2013.01)

(58) Field of Classification Search

CPC ..... F02B 75/044; F02B 75/04; F02D 15/02; F02D 15/04; F02D 2700/03; F02F 3/22; F02F 3/0015; F02F 3/28

See application file for complete search history.

(56) References Cited

U.S. PATENT DOCUMENTS

| | | | |
|---|---|---|---|
| 3,156,162 | A | 11/1964 | Wallace et al. |
| 3,311,096 | A | 3/1967 | Bachle et al. |
| 3,403,662 | A | 10/1968 | Blackburne |
| 4,016,841 | A | 4/1977 | Karaba et al. |
| 4,079,707 | A | 3/1978 | Karaba et al. |
| 4,785,790 | A | 11/1988 | Pfeffer et al. |
| 4,809,650 | A | 3/1989 | Arai et al. |
| 4,864,977 | A | 9/1989 | Hasegawa |
| 5,178,103 | A | 1/1993 | Simko |
| 5,257,600 | A | 11/1993 | Schechter et al. |
| 5,331,928 | A | 7/1994 | Wood |
| 5,476,074 | A | 12/1995 | Boggs et al. |

(Continued)

FOREIGN PATENT DOCUMENTS

| | | |
|---|---|---|
| DE | 3807244 | 3/1989 |
| DE | 4005903 A1 | 8/1991 |

(Continued)

*Primary Examiner* — Jacob M Amick
*Assistant Examiner* — Charles J Brauch
(74) *Attorney, Agent, or Firm* — Geoffrey Brumbaugh; McCoy Russell LLP

(57) ABSTRACT

Methods and systems are provided for a piston. In one example, system may comprise a piston comprising a chamber in which a piston bowl may actuated independent of an oscillation of the piston. The chamber may receive a hydraulic fluid in order to adjust a position of the piston bowl within the chamber, thereby adjusting a compression ratio of a combustion chamber in which the piston may oscillate.

17 Claims, 6 Drawing Sheets

(56) References Cited

U.S. PATENT DOCUMENTS

| | | | | |
|---|---|---|---|---|
| 7,377,238 | B2 | 5/2008 | Ishikawa et al. | |
| 7,637,241 | B2 | 12/2009 | Styron | |
| 8,151,691 | B2 | 4/2012 | Pirault et al. | |
| 2014/0272609 | A1* | 9/2014 | Nagayama | H01M 2/40 429/403 |
| 2016/0061142 | A1* | 3/2016 | Roelofs | B21J 5/08 92/260 |

FOREIGN PATENT DOCUMENTS

| | | | | |
|---|---|---|---|---|
| DE | 19944669 | A1 | 3/2001 | |
| DE | 102009048172 | A1 | 4/2011 | |
| EP | 2184496 | A1 | 5/2010 | |
| GB | 2223292 | A * | 4/1990 | F02B 75/044 |
| GB | 2223292 | A | 4/1990 | |
| JP | S63131839 | A | 6/1988 | |

* cited by examiner

METHODS AND SYSTEMS FOR A PISTON

CROSS REFERENCE TO RELATED APPLICATION

The present application claims priority to German patent application No. 102018210265.1, filed on Jun. 25, 2018. The entire contents of the above-listed application are hereby incorporated by reference for all purposes.

FIELD

The present description relates generally to a piston comprising a variable compression ratio adjusting element.

BACKGROUND/SUMMARY

Advancements toward the reduction of emissions from vehicles is a continuously desired characteristic as regulations become increasingly stringent. One method of decreasing vehicle emissions may include adjusting a compression ratio. By adjusting the compression ratio, a volume of a combustion chamber of an engine may be changed, which may provide more fuel efficient conditions.

Other examples of adjusting the compression ratio include where an eccentric bushing is provided as an intermediate element of the bearing assembly in the small or the large connecting rod eye. The eccentric bushing is rotatable, e.g. being switchable in steps between different working positions, wherein the different compression ratios c result from the different dead center positions in the various working positions of the eccentric bushing.

Another example is shown by Kloft in DE19944669 A1 describes a connecting rod in which an eccentric bushing is arranged in the large connecting rod eye. In order to be able to lock and release the eccentric bushing, a locking element of a locking device is provided, which can be brought into engagement with the bushing. Control, i.e. actuation, of the mechanical locking device comprising a cylinder and a piston movable in said cylinder can be performed hydraulically via pressurized oil from the engine lubricating oil circuit or via compressed air. A device via which the unlocked eccentric bushing is rotated or can be rotated selectively into a predeterminable position is not disclosed by DE19944669A1. This is a fundamental defect in the concepts described in the previous example for implementing a variable compression ratio ε.

To the extent that there are descriptions in the previous example of approaches to a solution which are distinguished by the use of an eccentric bushing, the proposed concepts generally extend no further than devices and methods for locking and releasing the bushing. Once released, there is no control over the eccentric bushing, i.e. no influence is exerted over the rotation process of the bushing itself.

Although diesel engines operate at higher compression ratios than spark ignition engines, there is also a demand for a variable compression ratio on diesel engines. Thus, in the case of a cold start, a high compression ratio ε should normally be the aim in order to ensure self-ignition of the fuel-air mixture while the diesel engine is still cold, whereas a lower compression ratio may have advantages in terms of emissions when the diesel engine has warmed up to operating temperature In one example, the issues described above may be addressed by a system for an engine comprising at least one cylinder with a piston positioned to oscillate therein, wherein the piston comprises a piston crown moveable within a piston body in response to a fluid entering a chamber. In this way, the piston crown may be actuated to adjust a compression ratio of the engine.

As one example, the piston crown oscillates within the chamber, dividing the chamber in separate chambers. That is to say, the chamber may be divided into a first chamber on a first side of the piston and a second chamber on a second side of the piston. Fluid may fill the first chamber via a check valve moving to an open position in response to a pressure of the fluid. The pressure of the fluid may be set via a fluid pump. If the pressure of the fluid is less than a threshold pressure, then the fluid in the first chamber may not be sufficiently pressurized to move the piston crown in a first direction. As such, a volume of the combustion chamber may increase, thereby increasing a compression ratio. If the pressure of the fluid is greater than the threshold pressure, then the fluid in the first chamber may be sufficient to move the piston crown in the first direction, thereby decreasing a volume of the second chamber and the compression ratio.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

The following description relates to systems and methods for a piston for an internal combustion engine for implementing a variable compression ratio c, which has a piston top with a recess, wherein the piston forms, together with a cylinder liner and a cylinder head, a combustion chamber of an associated cylinder. The piston can be connected in articulated fashion to one end of a connecting rod using a piston pin, wherein, to couple the piston to a crankshaft, the connecting rod can be connected in articulated fashion at another end to the crankshaft of the internal combustion engine, wherein oscillates along a piston longitudinal axis as the crankshaft revolves.

The disclosure furthermore relates to a method for operating an internal combustion engine having a piston of this kind.

An internal combustion engine of the stated type is used as a drive for motor vehicles or other motorized objects, for example. In the context of the present disclosure, the term internal combustion engine relates, in particular, to diesel engines but also to spark ignition engines and hybrid internal combustion engines, (e.g., internal combustion engines which are operated by a hybrid combustion method, and hybrid drives), which, in addition to the internal combustion engine, comprise at least one further torque source for driving a motor vehicle, e.g. an electric machine drive-connectable or drive-connected to the internal combustion engine, which outputs power instead of the internal combustion engine or in addition to the internal combustion engine.

Figure 3:
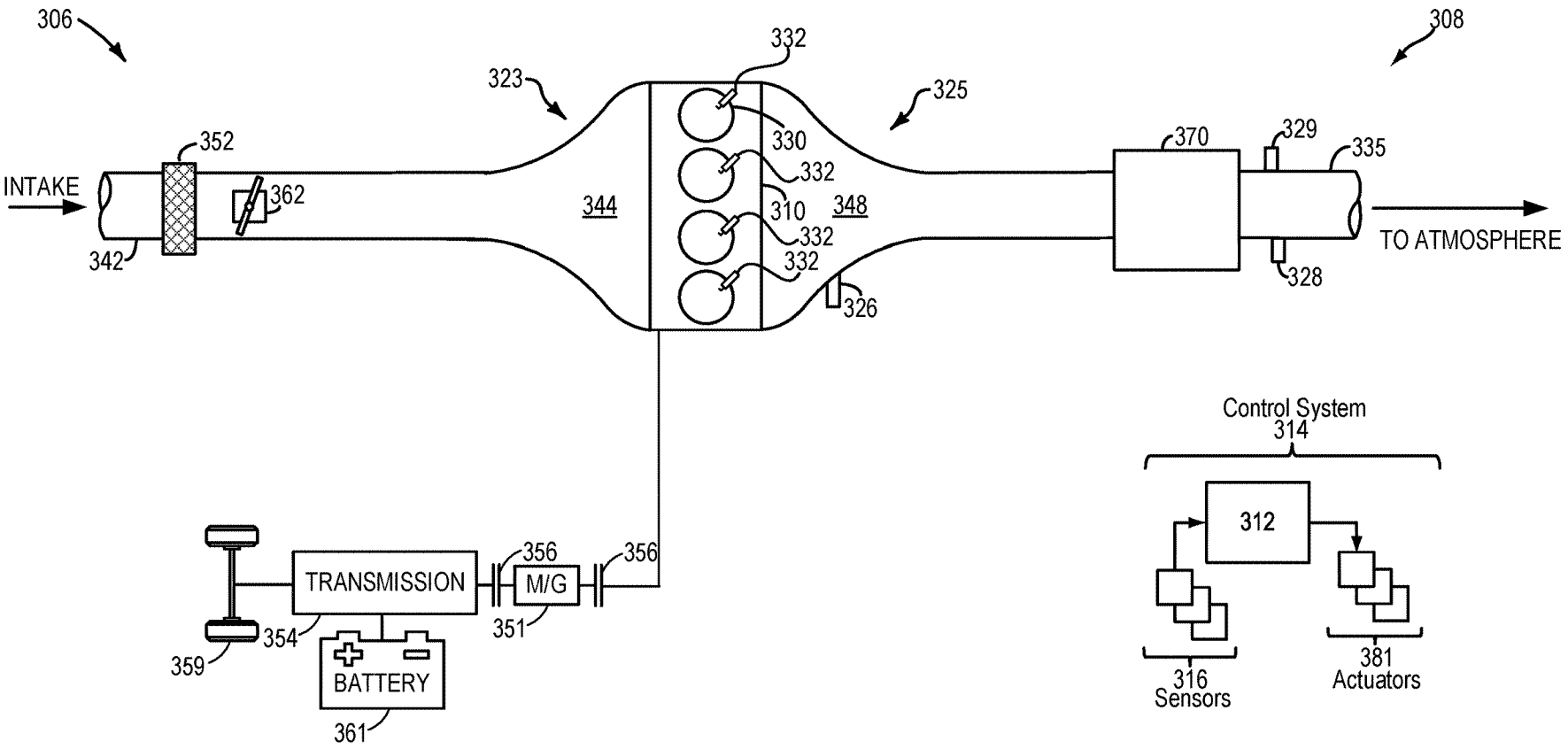
FIG. 3 shows an engine of a hybrid vehicle.

Internal combustion engines have a cylinder block and at least one cylinder head, which are connected to one another to form the cylinders and/or the combustion chambers. The cylinder block may be used as an upper crankcase half for supporting the crankshaft and for accommodating the piston and the cylinder liner of each cylinder. The cylinder head may serve to accommodate the valve trains used for the charge exchange. An example of an internal spark-ignited combustion engine is illustrated in FIG. 3.

In the course of the charge exchange, the combustion gases are discharged via the exhaust system via the at least one outlet port and the combustion air is fed in via the intake system via the at least one inlet port of the cylinder. According to previous examples, lift valves may be used to control the charge exchange in four stroke engines. The actuating mechanism including the associated valve is referred to as a valve train.

The crankshaft, which is supported in the crankcase, absorbs the connecting rod forces and transforms the oscillating stroke motion of the pistons into a rotary motion of the crankshaft. The upper crankcase half, which is formed by the cylinder block, is normally completed by the oil sump, which can be mounted on the cylinder block and serves as a lower crankcase half. The oil sump is used to collect and store the engine oil and is often part of the oil circuit. At least two bearings are provided in the crankcase to accept and support the crankshaft.

According to the previous examples, the connecting rod is provided with a small connecting rod eye at one end and a large connecting rod eye at the other end, wherein the connecting rod is connected in articulated fashion to the piston via a piston pin arranged in the small connecting rod eye. Via the large connecting rod eye, the connecting rod is rotatably mounted on a crankpin of the crankshaft.

Here, the piston is used to transmit the gas forces generated by combustion to the crankshaft. The gas forces to which the piston is subjected are in this way transmitted via the piston pin to the connecting rod and, from the latter, to the crankshaft.

Via the described arrangement of the piston, piston pin, connecting rod and crankshaft, the oscillating motion of the piston is transformed into a rotary motion of the crankshaft. Apart from a slight rotary component, the connecting rod moves predominantly in an oscillating manner in the direction of the cylinder liner longitudinal axis during this process.

The gas forces push the piston downward in the direction of the cylinder longitudinal axis, wherein, starting from top dead center, the gas forces impose an accelerated motion on the piston. The piston, which attempts to escape the gas forces with its downward motion, may take along the connecting rod connected in an articulated fashion thereto in this downward motion. For this purpose, the piston transmits the gas forces acting thereon to the connecting rod via the piston pin and attempts to accelerate it downward. As the piston approaches bottom dead center, it is decelerated together with the connecting rod and then performs a reversal of its motion at bottom dead center. The distance traveled by the piston in the cylinder liner on its way between top dead center and bottom dead center is referred to as the piston stroke, s.

The swept volume Vh of a cylinder is the product of the piston area AK and the piston stroke, s: Vh=(AK)(s). The cylinder volume with the piston at top dead center is referred to as the compression volume VC. The cylinder volume at the bottom dead center of the piston is the sum of the swept volume Vh and the compression volume Vc.

For the geometric compression ratio ε of the internal combustion engine is calculated based on equation 1 below $$\varepsilon=1+Vh/Vc \qquad \text{(equation 1)}$$

While, owing to the principle involved, diesel engines operate at very high compression ratios in order to ensure self-ignition of the fuel-air mixture, the maximum permissible compression ratio $\varepsilon_{max}$ in the case of spark ignition engines may be limited to relatively low compression ratios of, for example, ε≈10 in the case of naturally aspirated engines.

In the case of pressure-charged engines, which are becoming increasingly important, the geometric compression ratio may be lowered further for knock-free combustion, being limited to ε≈8 to 9, for example.

Figure 1:
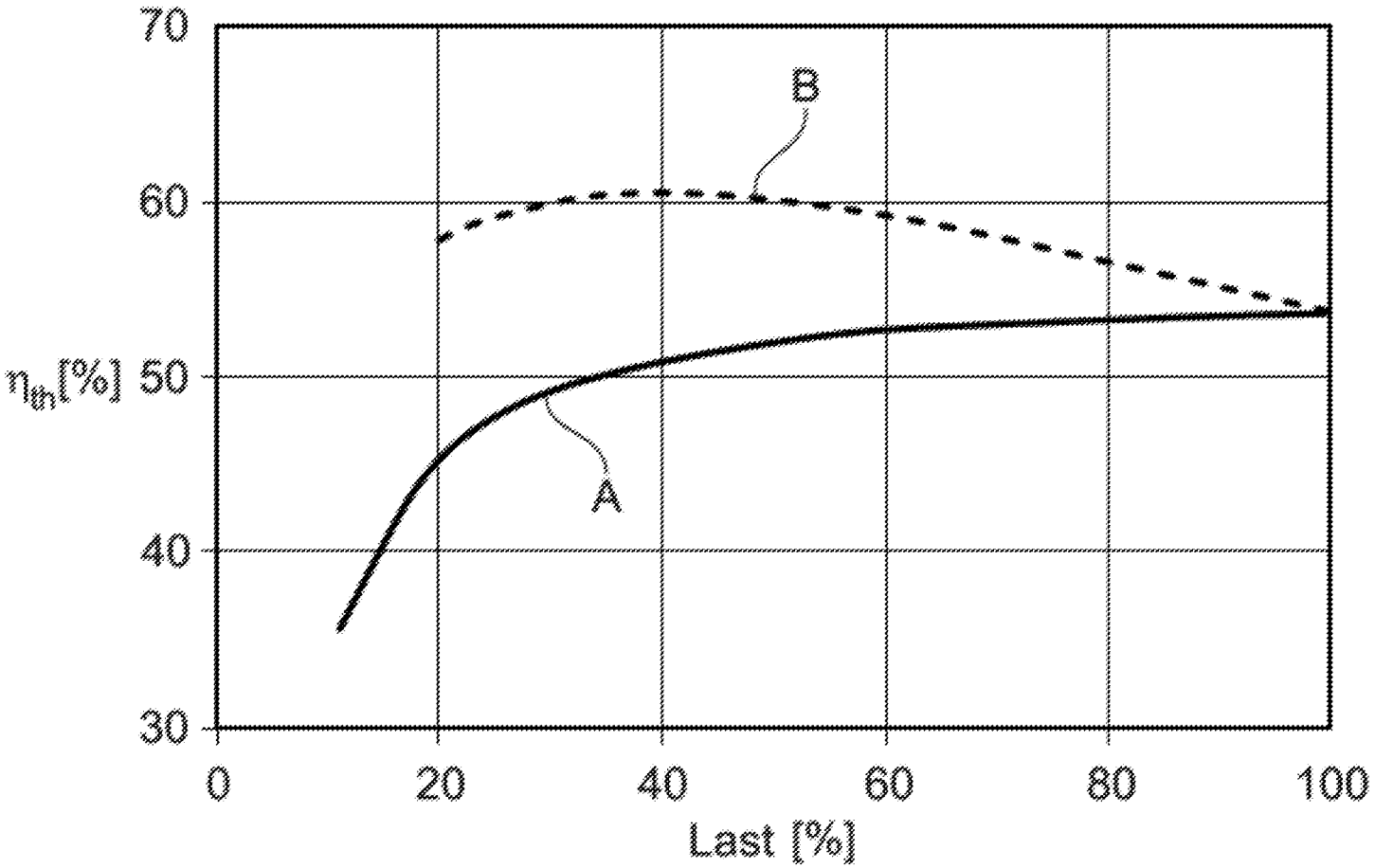
FIG. 1 shows the thermal efficiency $\eta_{th}$ of a naturally aspirated engine against the relative load for an invariable compression ratio ε on the one hand (curve A) and for a variable compression ratio ε on the other hand (curve B).
Figure 2A:
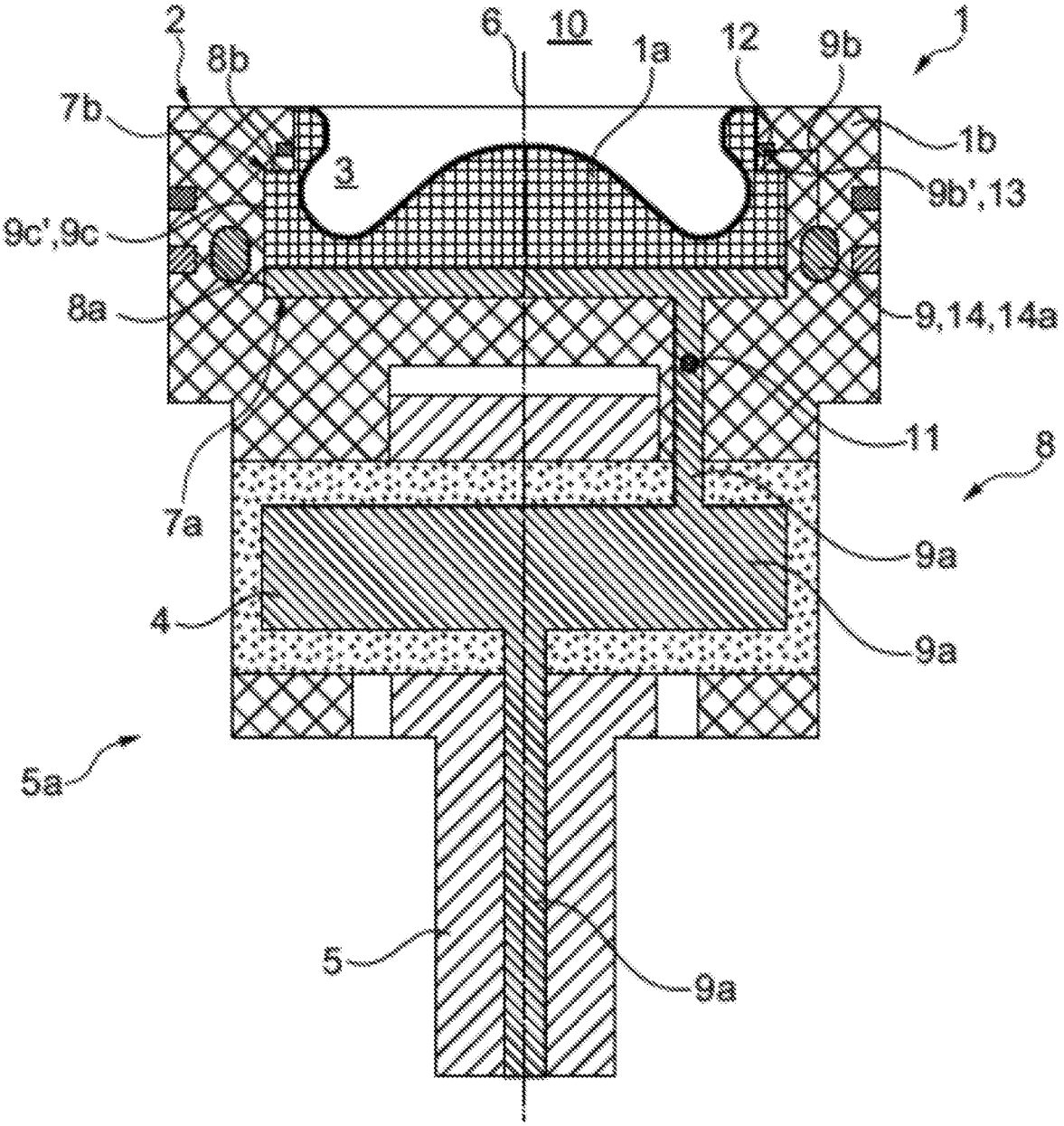
FIG. 2A shows a first embodiment of the piston having a first piston segment in the upper stop in a side view and in partial section.
Figure 2B:
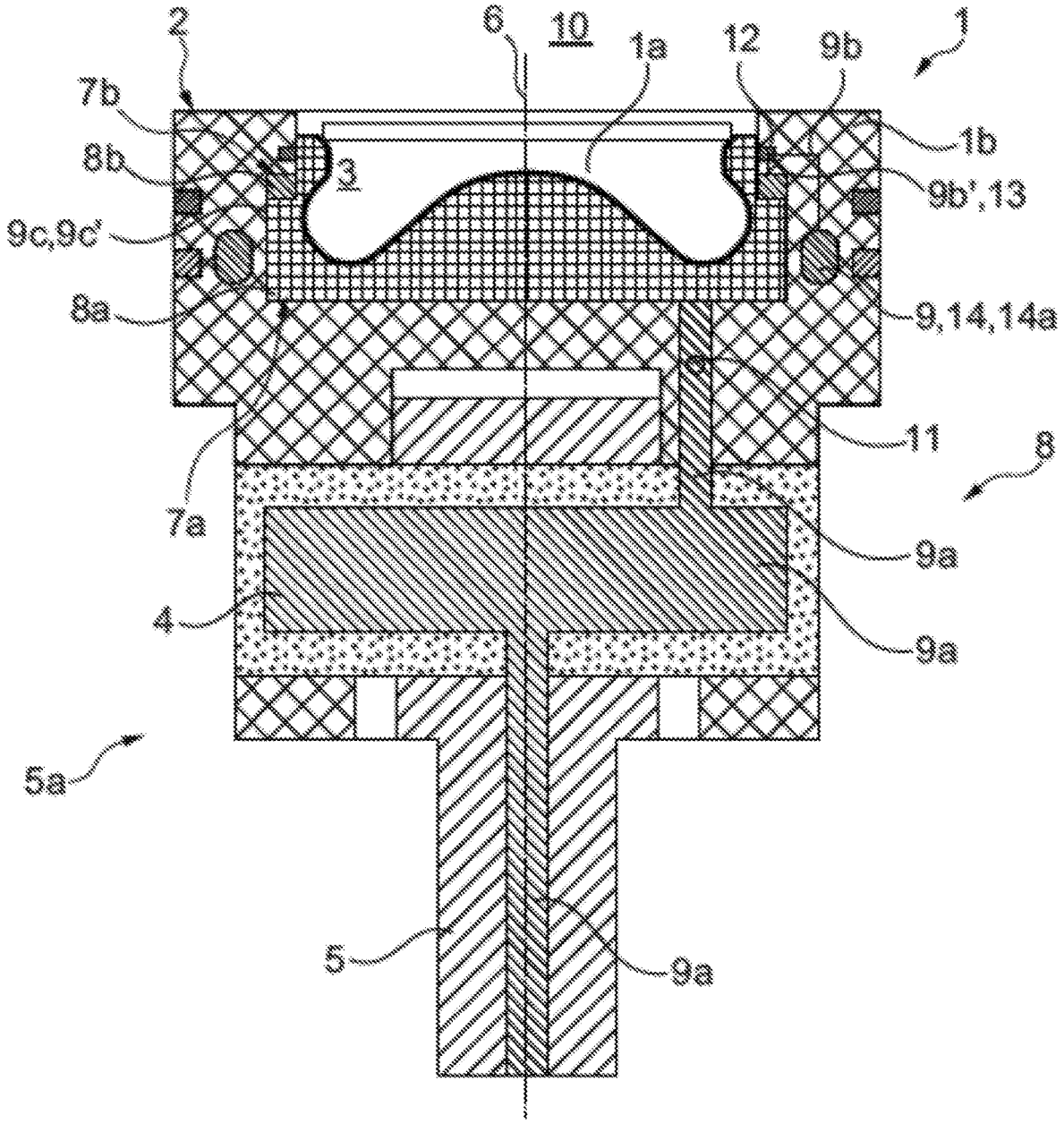
FIG. 2B shows schematically the piston illustrated in FIG. 2*a* having the first piston segment in the lower stop in a side view and in partial section.
Figure 4:
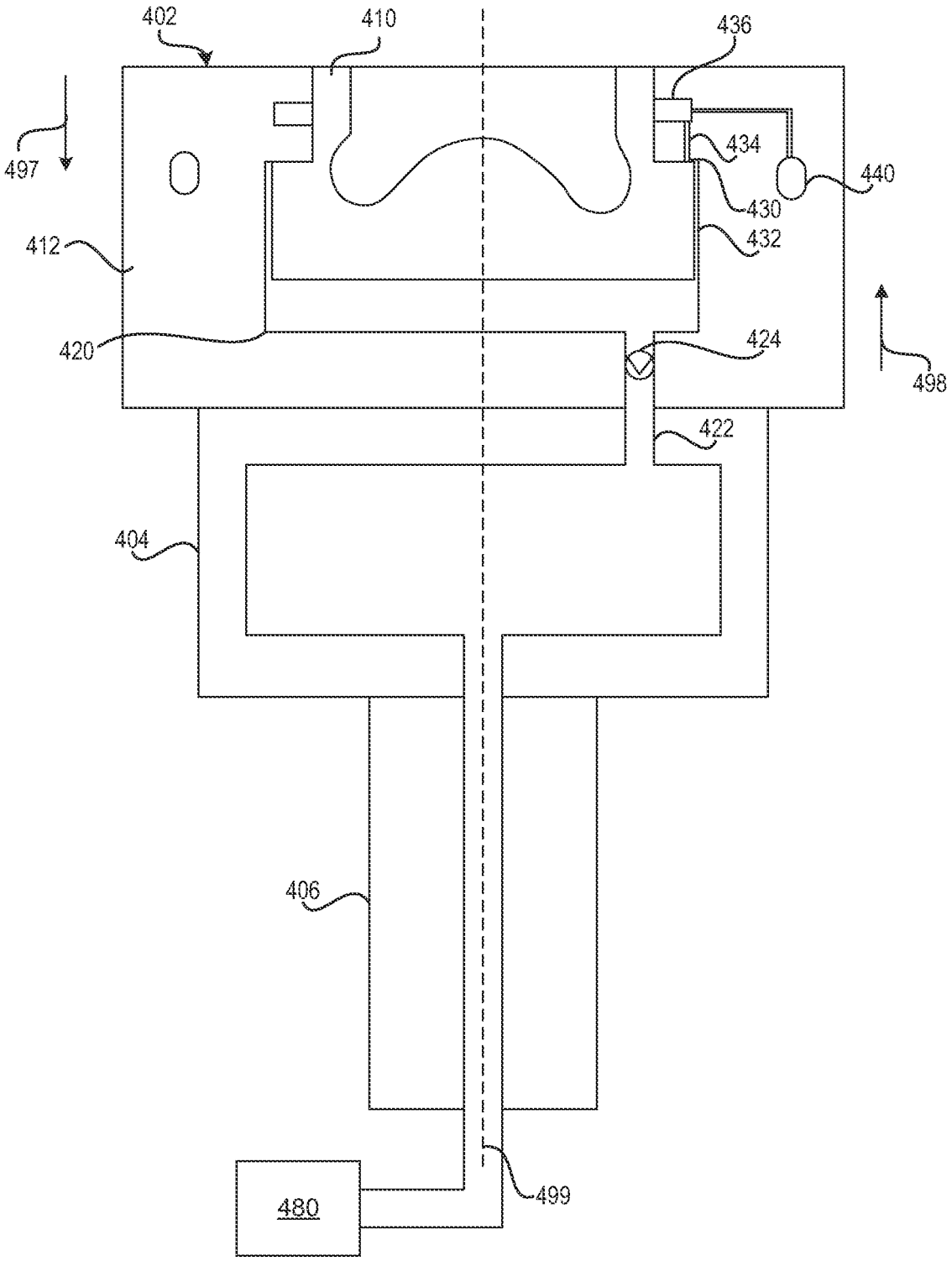
FIG. 4 shows a piston crown in a first position.
Figure 5:
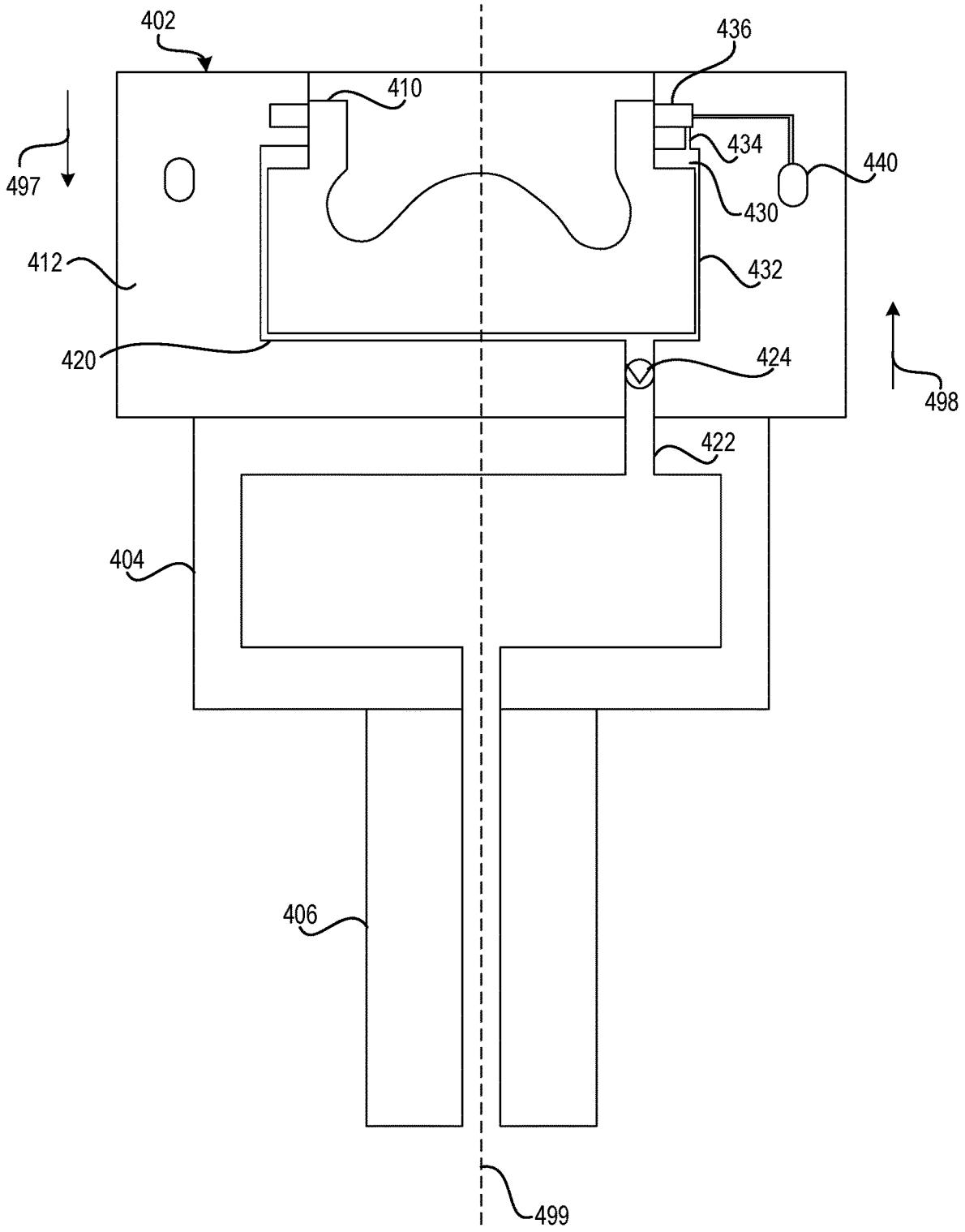
FIG. 5 shows the piston crown in a second position.

The relatively low compression ratios of spark ignition engines may be disadvantageous, especially in respect of fuel consumption, (e.g., in respect of efficiency). As the compression ratio ε decreases, efficiency η likewise decreases. That is to say that, in respect of maximum efficiency of the combustion process, the fresh cylinder charge should be as highly compressed as possible, but this also cannot be implemented in an unrestricted way for the reasons mentioned above, especially the tendency for knocking of the spark ignition engine close to full load. Efficiencies of various compression ratios are illustrated in FIG. 1. FIGS. 2A and 4 illustrate an example of a piston of the present disclosure, wherein the piston is manufactured as two pieces, with a first piece correspond to a piston crown and a second piece corresponding to a piston body. The piston crown is positioned to move within a chamber of the piston body. In FIGS. 2A and 4, the piston crown is in a first position where a volume of the combustion chamber is reduced (e.g., a compression ratio is increased). In FIGS. 2B and 5, the piston crown is in a second position, wherein the volume of the combustion chamber is increased (e.g., the compression ratio is decreased).

One approach to resolving this conflict consists in providing the internal combustion engine with a variable compression ratio c, more specifically in such a way that the compression ratio ε is increased with decreasing load, i.e. in the direction of partial load, starting from full load. In this way, it would be possible to compensate at least partially for a fundamental disadvantage of spark ignition engines relative to diesel engines, said disadvantage being specific to partial loads.

Owing to the fact that an internal combustion engine is operated predominantly in the partial load range, this offers great potential in respect of the achievable fuel saving. An efficiency-optimized alteration and/or adaptation of the compression ratio ε to the respective operating point allows compression ratios of ε≈14 to 15, and hence a significant reduction in consumption in the partial load range, even in the case of spark ignition engines.

FIG. 1 uses the example of a naturally aspirated engine to show the improvement in efficiency which could be achieved via a variable compression ratio ε. In this case, the thermal efficiency $\eta_{th}$ is plotted against the load, based on full load, wherein curve A is based on a constant compression ratio ε=9 and curve B is based on a variable compression ratio ε.

If the internal combustion engine is operated in the partial load range, e.g. at 20% of full load, efficiency can be increased by adapting the compression ratio, e.g. ε≈14, by about 12%. Toward higher loads, this potential decreases continuously, with the result that, when operating the internal combustion engine at 80% of full load, efficiency improvements of about 3% are all that can then be achieved via variable compression.

The previous example includes a number of approaches to a solution for implementing a variable compression ratio ε while an internal combustion engine is in operation, and just three of these will be presented briefly by way of example.

One way of implementing a variable compression ratio ε is to embody the connecting rod as a two-part connecting rod. Here, the connecting rod comprises an upper rod, which is connected in an articulated fashion to the piston, and a lower rod, which is articulated on the crankshaft, wherein the upper rod and the lower rod are likewise connected in articulated fashion to one another to enable them in this way to be pivoted relative to one another. Thus, this is a connecting rod which is of variable length along an imaginary line L connecting the two ends of the connecting rod to one another. Here, the imaginary line L extends, on the one hand, through the bearing in which the upper rod is rotatably connected to the piston, i.e. through the small connecting rod eye, and, on the other hand, through the bearing in which the lower rod is mounted on the crankshaft, i.e. through the large connecting rod eye. If the distance between these two bearings along the connecting line L between them is understood as the length of the connecting rod, this length can be altered by pivoting the upper and the lower rod relative to one another, i.e. by bending the two-part connecting rod to a greater or lesser extent.

Here, the setting of the compression ratio ε is executed via an articulated rod, which is connected in articulated fashion to the upper rod and is mounted rotatably on an eccentric shaft supported in the engine housing. By rotation of the eccentric shaft and the resulting changes in the dead center positions of the piston, the compression ratio can be varied within wide limits, e.g. between $\varepsilon_{min}\approx 8$ and $\varepsilon_{max}\approx 15$.

The inventors have identified some disadvantages with regard to the mechanical adjusting device of the described approach to a solution for implementing a variable compression ratio since a considerable part of the adjusting device, particularly the articulated rod, participates in the oscillating and rotary motion of the crank mechanism.

The oscillating motion of the piston and of the connecting rod together with the components of the adjusting device leads to high accelerations and decelerations, which increase as the square of the crankshaft speed and accordingly cause high dynamic inertia forces. These dynamic inertia forces impose considerable loads on the crank mechanism and play a significant role in the design of the components as regards the strength thereof.

It is therefore fundamentally an aim to minimize the oscillating masses and to design the components in a way which saves materials, although the desired strength of the components imposes limits on this procedure. The use of a mechanical adjusting device which participates in the oscillating motion thus runs counter to the aim of reducing the oscillating masses.

Another possible way of implementing a variable compression ratio ε is to construct the connecting rod from a plurality of connecting rod pieces which are arranged in such a way as to be movable telescopically one inside the other. The rod length is varied by pushing the connecting rod pieces together or pulling them apart. For this purpose, there is a need, in turn, for a mechanical adjusting device which, by virtue of the principle involved, as with the above-described adjusting device, must be coupled mechanically to the connecting rod, as a result of which part of this adjusting device once again participates in the oscillating and rotary motion of the crank mechanism. The disadvantages are those already mentioned above.

Moreover, the connecting rods of variable length known from the previous example already lead to an increase in the oscillating and rotating masses as compared with a conventional connecting rod, further intensifying the disadvantageous effects described.

In one example, to partially solve the issues described above a piston for an internal combustion engine for implementing a variable compression ratio c, which has a piston top with a recess, wherein the piston forms, together with a cylinder liner and a cylinder head, a combustion chamber of an associated cylinder, can be connected in articulated fashion to one end of a connecting rod using a piston pin, wherein, to couple the piston to a crankshaft, the connecting rod can be connected in articulated fashion at another end to the crankshaft of the internal combustion engine, and oscillates along a piston longitudinal axis as the crankshaft revolves. The piston may be constructed in a modular manner from at least two segments, wherein a first piston segment comprising the recess is mounted in a second piston carrier segment in such a way as to be movable along the piston longitudinal axis, between a lower stop and an upper stop, and the piston is equipped with a hydraulic adjusting device for moving the first piston segment along the piston longitudinal axis.

The piston according to the disclosure has a plurality of parts and comprises at least two segments, which can be moved relative to one another, wherein these segments as such can also once again be of modular construction; in order to allow or simplify assembly, for example.

The at least two segments of the piston according to the disclosure are movable relative to one another along the piston longitudinal axis between a lower stop and an upper stop, wherein a first piston segment comprising the piston recess is mounted in a second piston carrier segment.

The first piston segment can be moved into the combustion chamber together with the piston recess in the direction of the cylinder head, (e.g., in the direction of the combustion chamber roof, also referred to as a firedeck), in order to increase the compression ratio ε. The movement travel in this direction is limited by an upper stop, against which the first segment is brought to rest. If the first piston segment is moved in the opposite direction, (e.g., in the direction of the piston pin or connecting rod), the compression ratio ε can be lowered. The movement travel in this direction is limited by a lower stop, against which the first segment is once again brought to rest.

According to the disclosure, a hydraulic adjusting device is provided for moving the first piston segment along the piston longitudinal axis, said device having a large number of advantages, particularly in respect of the space requirement, weight and complexity, over a mechanical adjusting device of the kind known from the previous example. In particular, an unwanted increase in the rotating, but also of the oscillating, masses of the crank mechanism is very largely avoided.

Moreover, a hydraulic adjusting device can benefit from an oil circuit which any internal combustion engine normally has.

The piston according to the disclosure at least partially solves the disadvantages known from the previous example via which it is possible in a simple manner to implement a change in the compression ratio ε.

Further advantageous embodiments of the piston according to the disclosure are discussed in connection with the dependent claims.

Embodiments of the piston in which the hydraulic adjusting device comprises a first chamber, which can be formed between the first piston segment and the lower stop of the second piston carrier segment and can be supplied with oil via a feed line, and comprises a second chamber, which can be formed between the first piston segment and the upper stop of the second piston carrier segment and is at least connectable to an oil circuit via a return line are advantageous.

According to the disclosure, the first and the second chamber are chambers which are partially or completely formed only in the course of the movement of the first piston segment and which can also completely disappear (e.g., be sealed), depending on the position of the first piston segment; e.g. when the first piston segment comes to rest in the lower or upper stop.

The first chamber is supplied with oil via a feed line. The second chamber is at least connectable to an oil circuit via a return line to enable oil to be discharged from the second chamber. The term "at least connectable" indicates that the connection is either a permanent connection or, alternatively, a connection which can be at least temporarily interrupted, e.g. using a shutoff element.

The main flow direction of the oil, i.e. the oil flow or oil delivery through the chambers and the connecting lines, is preferably from the feed line, through the chambers, and back into the oil circuit via the return line.

In this context, embodiments of the piston in which the first chamber and the second chamber are connected hydraulically to one another via a transfer line are advantageous. The second chamber is supplied by the first chamber, via the transfer line, with oil coming from the first chamber.

In this context, embodiments of the piston in which the transfer line is designed as an annular gap between the first piston segment and the second piston carrier segment, extending along the piston longitudinal axis, are advantageous. The annular gap is preferably designed as a restrictor, making a transfer flow more difficult or delaying it.

Embodiments of the piston in which a check valve is arranged in the feed line, said valve permitting an oil inflow to the first chamber and counteracting an oil outflow from the first chamber, are advantageous. This embodiment ensures that the main flow direction of the oil, as already explained above, is directed or leads from the first chamber, via the transfer line, into the second chamber and from the second chamber, via the return line, to the oil circuit.

Embodiments of the piston in which the feed line extends in the piston and/or in the piston pin and/or in the connecting rod are advantageous. In the present case, the oil supply to the first chamber can take place from the main oil gallery of the crankshaft or via the crankshaft itself, wherein the demanded oil pressure to deliver the oil, in particular to open a check valve that is provided, can be built up or provided using an oil pump provided in the oil circuit.

Embodiments of the piston in which a further chamber is arranged in the return line are advantageous. The further chamber is used to provide a minimum oil quantity to ensure that, in the case of slight pumping of the piston, the second chamber is always filled with oil and no air enters the second chamber.

The section of the return line between the further chamber and the second chamber is preferably designed as a restrictor. The speed of movement of the piston recess is influenced by the oil pressure supplied but is also decisively defined or structurally set via the dimensioning of the chambers and of the single connecting line.

In this context, embodiments of the piston in which one section of the return line between the further chamber and the second chamber is designed as a restrictor element are therefore also advantageous.

Embodiments of the piston in which the piston is equipped with an oil cooling system are advantageous.

In this context, embodiments of the piston in which the oil cooling system comprises at least one cooling duct, which extends in the second piston carrier segment and surrounds the first piston segment circumferentially, at least in some section or sections, are advantageous.

The return line can then advantageously open into the oil cooling system, thereby simplifying, in particular shortening the line system of the hydraulic adjusting device.

In this context, embodiments of the piston in which the return line opens into the at least one cooling duct of the oil cooling system are therefore also advantageous.

The second partial object underlying the disclosure, namely that of indicating a method for operating an internal combustion engine having a piston of a type described above, is achieved by a method which is characterized in that the first piston segment is moved along the piston longitudinal axis, using the hydraulic adjusting device, in order to vary the compression ratio ε.

To operate a self-ignition internal combustion engine, embodiments of the method in which the compression ratio ε is increased in the case of a cold start and/or in the warm-up phase are advantageous. This procedure ensures self-ignition of the fuel-air mixture, even when the internal combustion engine is still cold or has not warmed up to the operating temperature.

In this context, embodiments of the method in which the compression ratio ε is reduced after a cold start and/or after the warm-up phase in order to improve the emissions behavior of the internal combustion engine are advantageous.

Embodiments of the method in which the compression ratio ε of the spark ignition internal combustion engine is increased with decreasing load can also be advantageous.

Embodiments of the method in which the compression ratio ε of the spark ignition internal combustion engine is reduced with increasing load can likewise be advantageous.

Adjustment of the compression ratio ε may be further balanced with a knock risk, wherein the compression ratio ε may be reduced if the knock risk is greater than a threshold risk. However, the compression ratio ε may be increased if the knock risk is less than the threshold risk and it is desired to increase an engine temperature or to increase engine efficiency at partial loads, as described above.

The two method variants described above take account both of the fact that knocking can be reliably prevented in the high-load range by limiting or reducing the compression ratio ε and also with the fact that efficiency can be improved by higher compression ratios E in the partial load range without the risk of self-ignitions of the fuel-air mixture, i.e. knocking.

FIGS. 2A-5 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example. It will be appreciated that one or more components referred to as being "substantially similar and/or identical" differ from one another according to manufacturing tolerances (e.g., within 1-5% deviation).

FIG. 1 has already been discussed in detail in the introduction to the description, and therefore attention is drawn to these explanations.

FIG. 2A shows schematically a first embodiment of the piston 1 having a first piston segment 1*a* in the upper stop 7*b* in a side view and partially in section, i.e. in a section along the piston longitudinal axis 6 and perpendicularly to the crankshaft. The axis of rotation of the crankshaft is perpendicular to the plane of the drawing and to the piston longitudinal axis 6. A connecting rod 5 rotatably mounted on the crankshaft is connected movably to the piston 1 via a piston pin 4. As the crankshaft revolves, the piston oscillates along the piston longitudinal axis 6.

FIG. 2B shows schematically the piston 1 illustrated in FIG. 2A having the first piston segment 1*a* in the lower stop 7*a* in a side view and in partial section.

The laterally arranged piston skirt is used to guide the piston 1 in the cylinder liner and to accommodate piston rings for sealing the combustion chamber 10 with respect to the crankcase and vice versa. The piston top 2 of the piston 1 has an omega-shaped piston recess 3.

The piston 1 is constructed in a modular manner from at least two segments 1*a*, 1*b*, wherein a first piston segment 1*a* comprising the recess 3 is mounted in a second piston carrier segment 1*b* in such a way as to be movable. In this case, the first piston segment 1*a* is mounted in the second piston carrier segment 1*b* in such a way as to be movable along the piston longitudinal axis 6 between a lower stop 7*a* (see FIG. 2B) and an upper stop 7*b* (see FIG. 2A).

A hydraulic adjusting device 8 is provided for moving the first piston segment 1*a*. The hydraulic adjusting device 8 comprises two chambers 8*a*, 8*b*, wherein filling a first chamber 8*a* with oil moves the first piston segment 1*a* in the direction of the combustion chamber 10 to increase the compression ratio ε and filling a second chamber 8*b* with oil moves the first piston segment 1*a* in the opposite direction, namely in the direction of the piston pin 4, to reduce the compression ratio ε.

The first chamber 8*a* is formed between the first piston segment 1*a* and the lower stop 7*a* of the second piston carrier segment 1*b* when oil is fed in, and is supplied with oil via a feed line 9*a*. A check valve 11 is arranged in the feed line 9*a*, said valve permitting an oil inflow to the first chamber 8*a* and counteracting an oil outflow from the first chamber 8*a*. In the present example illustrated in FIG. 2A, the feed line 9*a* passes through the connecting rod 5 and the piston pin 4 into the piston 1 and to the first chamber 8*a*.

The second chamber 8*b* is formed between the first piston segment 1*a* and the upper stop 7*b* of the second piston carrier segment 1*b* when oil is fed in, and is connected hydraulically to the first chamber 8*a* via a transfer line 9*c*. That is to say that the second chamber 8*b* is supplied via the transfer line 9*c* with oil coming from the first chamber 8*a*.

The transfer line 9*c* is designed as an annular gap 9*c*' between the first piston segment 1*a* and the second piston carrier segment 1*b*, extending along the piston longitudinal axis 6.

Moreover, the second chamber 8*b* is connected to an oil circuit 9 via a return line 9*b*. The return line 9*b* opens into the cooling duct 14*a* of an oil cooling system 14, said duct extending in the second piston carrier segment 1*b* and surrounding the first piston segment 1*a* circumferentially.

The section 9*b*' of the return line 9*b* between a further chamber 12 and the second chamber 8*b* is designed as a restrictor element 13 in order to restrict the oil flow from the second chamber 8*b* to the further chamber 12, more specifically in such a way that less oil can flow out of the second chamber 8*b* than can flow in via the transfer line 9*c* from the first chamber 8*a*. The further chamber 12 serves to provide a minimum oil quantity in order to ensure that, in the case of slight pumping of the piston 1, the second chamber 8*b* is always filled with oil and no air enters the second chamber 8*b*.

To extend the first piston segment 1*a*, the feed duct 9*a* is subjected to an oil pressure of, for example, 5 bar using an oil pump, preferably when the piston 1 is moving downward, i.e. in the direction of bottom dead center, and the inertia forces are acting upward counter to the direction of movement. If there are no high pressure forces acting on the first piston segment 1*a* owing to combustion, the applied pressure is sufficient to open the check valve 11, with the result that oil flows into the first chamber 8*a*. In this case, the first piston segment 1*a* is moved upward until the upper stop 7*b* is reached or the downward-acting forces on the first piston segment 1*a* increase to such an extent that the pressure in the first chamber 8*a* rises and the check valve 11 is closed. The oil is prevented from being displaced back into the feed duct 9*a*. There is only a slight oil flow via the restricted annular gap 9*c*' into the second chamber 8*b*. The second chamber 8*b* is furthermore connected to the oil circuit 9 via a restricted connection 9*b*' and the further chamber 12 via the return line 9*b*. The movement can normally take several crankshaft revolutions and can take place in steps.

To retract the first piston segment, the oil pressure in the feed line 9*a* is lowered to such an extent that no oil or only a little oil is delivered or flows into the first chamber 8*a*. In each combustion cycle, the gas forces acting on the piston top 2 and the first piston segment 1*a* displace oil from the first chamber 8*a* into the second chamber 8*b* via transfer line 9*c*. In some cases, this is more oil than can flow into the first chamber 8*a* to replace it. Since it is always the case that more oil flows out of the first chamber 8*a* than the second chamber 8*b* may contain or can absorb, the second chamber 8*b* may always filled with oil, and there is an outflow of oil via the further chamber 12 into the piston cooling duct 14*a*.

In one example, the system illustrated in the examples of FIGS. 2A and 2B represents an arrangement to adjust a compression ratio by adjusting a piston bowl in a piston. The movement of the piston bowl may be hydraulically achieved by a variation of an oil pressure in a chamber of the piston. The oil pressure may be adjusted via an oil pump already arranged on an engine. A separate oil supply to the piston may be arranged on the engine, wherein the separate oil supply may flow oil to the chamber of the piston. The piston may be manufactured as two pieces, a first piece corresponding to a piston bowl and the second piece corresponding to a piston body (e.g., a remaining portion of the piston not including the piston bowl). The piston bowl may be actuated along a longitudinal axis, wherein the piston may also be actuated along the longitudinal axis.

The piston may comprise a chamber fluidly coupled to a channel which may be pressurized to actuate the piston bowl. If the pressure of the channel is less than a threshold pressure, then the pressure acting on the piston bowl in the chamber may be insufficient to press the piston bowl upward into the first position illustrated in FIG. 2A. Thus, when the pressure of the channel is less than the threshold pressure, the piston bowl may move downward along the longitudinal axis and compress a first volume of the chamber. The piston bowl may move upward along the longitudinal axis and compress the second volume of the chamber, thereby increasing the volume of the first chamber in response to the fluid in the feed line exceeding the threshold pressure.

In some examples, even if the fluid pressure is greater than the threshold pressure, the piston bowl movement may be stopped short in response to an in-cylinder pressure exceeding the fluid pressure. As such, the compression ratio may not be reduced to a lowest value. A return flow from the chamber to the feed line may be blocked via a check valve arranged in the feed line, the check valve configured to allow fluid to only flow from the feed line to the chamber.

If the pressure in the feed line, and therefore the chamber, is reduced to a value less than the threshold pressure, then the piston bowl may press against the chamber in the downward direction to drive fluid into the second volume of the chamber, wherein the fluid in the second volume flows to a cooling chamber.

The second volume and the first volume may be continuously fluidly coupled to one another via an annular gap of the chamber. Thus, a volume of the annular gap may correspond to a difference in diameter of the chamber and the piston bowl. The first volume may be closer to the piston pin than the second volume. Thus, the second volume may be closer to a cylinder head than the first volume.

In some examples, the compression ratio may be adjusted in response to one or more of an engine temperature, engine load, engine speed, and the like. In one example, the compression ratio is increased, via decreasing the fluid pressure, in response to the engine temperature being less than a threshold temperature (e.g., a cold-start is occurring) and a knock risk being less than a threshold risk. If the engine temperature is greater than the threshold temperature and/or if the knock risk is greater than the threshold risk, then the compression ratio is reduced via increasing the fluid pressure.

FIG. 3 shows a schematic depiction of a hybrid vehicle system 306 that can derive propulsion power from engine system 308 and/or an on-board energy storage device. An energy conversion device, such as a generator, may be operated to absorb energy from vehicle motion and/or engine operation, and then convert the absorbed energy to an energy form suitable for storage by the energy storage device.

Engine system 308 may include an engine 310 having a plurality of cylinders 330. Each cylinder of the plurality of cylinders 330 comprises a spark plug 332. Engine 310 includes an engine intake 323 and an engine exhaust 325. Engine intake 323 includes an air intake throttle 362 fluidly coupled to the engine intake manifold 344 via an intake passage 342. Air may enter intake passage 342 via air filter 352. Engine exhaust 325 includes an exhaust manifold 348 leading to an exhaust passage 335 that routes exhaust gas to the atmosphere. Engine exhaust 325 may include one or more emission control devices 370 mounted in a close-coupled position or in a far underbody position. The one or more emission control devices may include a three-way catalyst, lean NOx trap, diesel particulate filter, oxidation catalyst, etc. It will be appreciated that other components may be included in the engine such as a variety of valves and sensors, as further elaborated in herein. In some embodiments, wherein engine system 308 is a boosted engine system, the engine system may further include a boosting device, such as a turbocharger.

Vehicle system 306 may further include control system 314. Control system 314 is shown receiving information from a plurality of sensors 316 (various examples of which are described herein) and sending control signals to a plurality of actuators 381 (various examples of which are described herein). As one example, sensors 316 may include exhaust gas sensor 326 located upstream of the emission control device, temperature sensor 328, and pressure sensor 329. Other sensors such as additional pressure, temperature, air/fuel ratio, and composition sensors may be coupled to various locations in the vehicle system 306. As another example, the actuators may include the throttle 362.

Controller 312 may be configured as a conventional microcomputer including a microprocessor unit, input/output ports, read-only memory, random access memory, keep alive memory, a controller area network (CAN) bus, etc. Controller 312 may be configured as a powertrain control module (PCM). The controller may be shifted between sleep and wake-up modes for additional energy efficiency. The controller may receive input data from the various sensors, process the input data, and trigger the actuators in response to the processed input data based on instruction or code programmed therein corresponding to one or more routines.

In some examples, hybrid vehicle 306 comprises multiple sources of torque available to one or more vehicle wheels 359. In other examples, vehicle 306 is a conventional vehicle with only an engine, or an electric vehicle with only electric machine(s). In the example shown, vehicle 306 includes engine 310 and an electric machine 351. Electric machine 351 may be a motor or a motor/generator. A crankshaft of engine 310 and electric machine 351 may be connected via a transmission 354 to vehicle wheels 359 when one or more clutches 356 are engaged. In the depicted example, a first clutch 356 is provided between a crankshaft and the electric machine 351, and a second clutch 356 is provided between electric machine 351 and transmission 354. Controller 312 may send a signal to an actuator of each clutch 356 to engage or disengage the clutch, so as to connect or disconnect crankshaft from electric machine 351 and the components connected thereto, and/or connect or disconnect electric machine 351 from transmission 354 and the components connected thereto. Transmission 354 may be a gearbox, a planetary gear system, or another type of transmission. The powertrain may be configured in various manners including as a parallel, a series, or a series-parallel hybrid vehicle.

Electric machine 351 receives electrical power from a traction battery 361 to provide torque to vehicle wheels 359. Electric machine 351 may also be operated as a generator to provide electrical power to charge battery 361, for example during a braking operation.

Turning now to FIGS. 4 and 5, they show a piston 402 comprising a piston pin 404 physically coupled to a connecting rod 406. The connecting rod 406 is rotatably coupled to the piston 402 via the piston pin 404, wherein the piston 402 oscillates along the axis 499. The motion of the piston 402 is transformed into rotational motion of a crankshaft via the connecting rod 406. In one example, the piston 402, piston pin 404, and connecting rod 406 are used similarly to the piston 1, the piston pin 4, and the connecting rod 5 of FIGS. 2A and 2B, respectively.

The piston 402 may be manufactured as two pieces, including a piston bowl 410 and a piston body 412. The piston bowl 410 may be moveably arranged in the piston body 412 such that a position of the piston bowl 410 may be adjusted along the axis 499. The piston bowl 410 may be hydraulically actuated as will be described herein, wherein the piston bowl 410 is guided within the piston body 412. By actuating the piston bowl 410, various compression ratios of a combustion chamber may be realized, such as in a combustion chamber of one of the cylinders 30 of FIG. 3.

A first chamber 420 may be arranged below the piston bowl 410. The first chamber 420 may be fluidly coupled to an oil circuit via a feed line 422. In some examples, the first chamber 420 is selectively fluidly coupled to the feed line 422 via a check valve 424. In one example, the check valve 424 is a one-way check valve such that oil, or another hydraulic fluid, may flow from only the feed line 422 to the first chamber 420. As such, oil may not flow from the first chamber 420 to the feed line 422. Oil pressure generated in the feed line 422, and in other portions of the oil circuit, may be generated by an oil pump 480. The oil pump 480 may be configured to flow oil to other components of the vehicle, such as a transmission and the like. Alternatively, the oil pump 480 may be dedicated to flowing oil to only the feed line 422.

When oil at least partially fills the first chamber 420, the piston bowl 410 may be actuated in a first direction 498, parallel to the axis 499, in a first position as illustrated in the example of FIG. 4. In the first position, a compression ratio of the combustion chamber in which the piston 402 is arranged may correspond to a highest compression ratio of the combustion chamber. When in the first position, oil may enter the first chamber 420 by flowing from the feed line 422 through the check valve 424 being in an open position. The first position may further comprise where the feed line 422 is pressurized to a threshold pressure (e.g., 5 bar), which may be greater than in-cylinder pressure. As a result, the first chamber 420 may be filled with oil.

The first chamber 420 may be fluidly coupled to a second chamber 430 via an annular gap 432. The annular gap 432 may extend around a circumference of the piston bowl 410. In the example of FIG. 4, the volume of the second chamber 430 is substantially reduced. More specifically, the volume of the second chamber 430 may be reduced to a volume that may continue to flow oil to a return channel 434, while providing a minimum counter force to the piston bowl 410. The counter force may be in a second direction 497, opposite the first direction 498. In this way, the first position may further comprise the second chamber 430 being minimally filled with oil, such that the counter force is a lowest counter force while still flowing oil from the second chamber 430 to the return channel 434.

The return channel 434 may fluidly couple the second chamber 430 to a third chamber 436. The third chamber 436 may be an outlet of the second chamber 430. In some examples, additionally or alternatively, an amount of oil may remain in the second chamber 430 In the example of FIG. 4, oil is provided to the second chamber 430 via the first chamber 420 due to an increased oil pressure generated in the feed line 422. Oil from the second chamber 430 flows into the third chamber 436 and to a cooling chamber 440. The cooling chamber 440 may be arranged in an outer radial position of the piston body such that oil in the cooling chamber 440 may be adjacent to a cylinder coolant jacket. In this way, cooling of the piston 402 may be promoted regardless of the compression ratio.

A second position of the piston 402 is illustrated in FIG. 5. The piston bowl 410 may move to the second position by moving in the second direction 497, opposite the first direction 498. In one example, the piston bowl 410 may move in the second direction 497 in response to a pressure in the feed line 422 decreasing to a pressure less than the threshold pressure. In the second position, the piston bowl 410 may decrease a volume of the first chamber 420 by occupying a majority of the volume of the first chamber 420. In one example, the first chamber 420 may still receive oil when the piston bowl 410 is in the second position, however, the force of the oil in the first chamber 420 is not sufficient to press the piston bowl 410 in the first direction 498. As such, the compression ratio is decreased.

The second position of the piston 402 may further comprise where the volume of the second chamber 430 is increased to a maximum volume of the second chamber 430. Oil may flow to the second chamber 430 from the third chamber 436. As such, oil flow to the second chamber 430 may be reversed when the piston 402 is in the second position compared to the first position of FIGS. 2A and 4.

Said another way, the examples of FIGS. 4 and 5 show the piston comprising the piston bowl which may be moved within the chamber of the piston independently of a movement of the piston. Thus, if the piston moves in the first direction, the piston bowl may be moved in the second direction, opposite the first direction. Additionally or alternatively, if the piston moves in the first direction, the piston bowl may be stationary or also move in the first direction.

The piston bowl may divide the chamber into a first chamber (e.g., a lower volume or a lower chamber) and a second chamber (e.g., an upper volume or an upper chamber). The first chamber and the second chamber may be fluidly coupled to one another via an annular gap. The annular gap may represent a difference in diameters of the piston bowl and the chamber. As such, fluid may continuously be present in each of the first and second chambers to block the piston bowl from contacting surfaces of the piston body corresponding to the chamber.

A controller may comprise instructions stored on non-transitory memory that when executed may enable the controller to adjust a pressure of fluid in the feed line to adjust a compression ratio of the combustion chamber in response to a knock risk. In one example, the controller signals to an actuator of the oil pump to increase the pressure of the fluid in the feed line to increase the compression ratio if the knock risk is less than a threshold likelihood. In response, the check valve may move to an open position and allow the fluid to enter the first chamber. The fluid may press against the piston bowl and move it in the first direction toward the first portion, thereby increasing a volume of the first chamber and decreasing a volume of the second chamber. By doing this, the compression ratio of the combustion chamber may increase.

However, if the knock risk is greater than the threshold likelihood, then it may be desired to decrease the compression ratio. To do so, the controller may signal to the actuator of the oil pump to decrease the pressure of the fluid. As such, the pressure in the first chamber may decrease due to either low pressure fluid entering the first chamber or due to no fluid entering the first chamber from the feed line. The check valve may move to a fully closed position to block fluid from the feed line entering the first chamber in response to the pressure of the feed line being too low to open the check valve. At any rate, the piston bowl may press against the volume of the first chamber and decrease the volume of the first chamber. The piston bowl may press in the second direction, opposite the first direction, via pressure generated in the combustion chamber and via fluid pressure in the second chamber. A relatively small amount of fluid from the second chamber may enter the first chamber via the annular gap. As such, the compression ratio is decreased to decrease the knock risk.

In this way, a compression ratio of a combustion chamber may be adjusted in response to a pressure of a fluid pressing against a piston bowl. The fluid may enter a chamber within which the piston bowl may be actuated. The technical effect of adjusting the compression ratio via a fluid pressure is to increase fuel economy and decrease a knock risk while more easily adjusting the compression ratio relative to previous examples. While the fluid may decrease mechanical stress on components previously used to adjust the compression ratio, the fluid may further comprise the benefit of continuous temperature control of the piston. In this way, a longevity of the piston may also increase.

An embodiment of a piston for an internal combustion engine for implementing a variable compression ratio ε, which has a piston top with a recess comprises where the piston forms, together with a cylinder liner and a cylinder head, a combustion chamber of an associated cylinder. The piston can be connected in articulated fashion to one end of a connecting rod using a piston pin, wherein, to couple the piston to a crankshaft, the connecting rod can be connected in articulated fashion at another end to the crankshaft of the internal combustion engine, and oscillates along a piston longitudinal axis as the crankshaft revolves. The piston is constructed in a modular manner from at least two segments, wherein a first piston segment comprising the recess is mounted in a second piston carrier segment in such a way as to be movable along the piston longitudinal axis, between a lower stop and an upper stop, and where the piston is equipped with a hydraulic adjusting device for moving the first piston segment along the piston longitudinal axis.

A first example of the piston further comprises where the hydraulic adjusting device comprises a first chamber, which can be formed between the first piston segment and the lower stop of the second piston carrier segment and can be supplied with oil via a feed line, wherein the hydraulic adjusting device further comprises a second chamber, which can be formed between the first piston segment and the upper stop of the second piston carrier segment and is at least connectable to an oil circuit via a return line.

A second example of the piston, optionally including the first example, further comprises where the first chamber and the second chamber are connected hydraulically to one another via a transfer line.

A third example of the piston, optionally including one or more of the previous examples, further includes where the transfer line is designed as an annular gap between the first piston segment and the second piston carrier segment, extending along the piston longitudinal axis.

A fourth example of the piston, optionally including one or more of the previous examples, further includes where a check valve is arranged in the feed line, said valve permitting an oil inflow to the first chamber and counteracting an oil outflow from the first chamber.

A fifth example of the piston, optionally including one or more of the previous examples, further includes where the feed line extends in the piston and/or in the piston pin and/or in the connecting rod.

A sixth example of the piston, optionally including one or more of the previous examples, further includes where a further chamber is arranged in the return line.

A seventh example of the piston, optionally including one or more of the previous examples, further includes where one section of the return line between the further chamber and the second chamber is designed as a restrictor element.

An eighth example of the piston, optionally including one or more of the previous examples, further includes where the piston is equipped with an oil cooling system.

A ninth example of the piston, optionally including one or more of the previous examples, further includes where the oil cooling system comprises at least one cooling duct, which extends in the second piston carrier segment and surrounds the first piston segment circumferentially, at least in some section or sections.

A tenth example of the piston, optionally including one or more of the previous examples, further includes where the return line opens into the at least one cooling duct of the oil cooling system.

An embodiment of a method for operating an internal combustion engine having a piston of one or more of the previous examples, further comprises where the first piston segment is moved along the piston longitudinal axis, using the hydraulic adjusting device, in order to vary the compression ratio ε.

A first example of the method further includes where the compression ratio ε is increased in the case of a cold start and/or in the warm-up phase.

A second example of the method, optionally including the first example, further includes where the compression ratio ε is reduced after a cold start and/or after the warm-up phase.

An embodiment of a system, comprises an engine comprising at least one cylinder with a piston positioned to oscillate therein, wherein the piston comprises a piston crown moveable within a piston body in response to a fluid entering a chamber.

A first example of the system further comprises where the fluid is oil.

A second example of the system, optionally including the first example, further includes where the piston divides the chamber into a first chamber and a second chamber, wherein a volume of the first chamber is greater than a volume of the second chamber when the piston crown is in a first position.

A third example of the system, optionally including one or more of the previous examples, further includes where a compression ratio of the at least one cylinder is lowest when the piston crown is in the first position.

A fourth example of the system, optionally including one or more of the previous examples, further includes where the volume of the second chamber is greater than the volume of the first chamber when the piston crown is in a second position, wherein the compression ratio of the at least one cylinder is highest when the piston crown is in the second position.

A fifth example of the system, optionally including one or more of the previous examples, further includes where the chamber continuously receives the fluid via one or more of a feed line and a cooling chamber.

A sixth example of the system, optionally including one or more of the previous examples, further includes where the cooling chamber is arranged radially outward relative to the piston crown proximally to a cylinder liner.

A seventh example of the system, optionally including one or more of the previous examples, further includes where the feed line comprises a one-way check valve, wherein the one-way check valve allows the fluid to only flow from the feed line to the chamber.

An eighth example of the system, optionally including one or more of the previous examples, further includes where the piston crown is a piece of the piston separate from the piston body.

An embodiment of an engine comprises a plurality of combustion chambers each comprising a piston positioned to oscillate along an axis, the piston further comprising a chamber including a piston crown positioned to oscillate therein along the axis in response to a pressure of a fluid in the chamber.

A first example of the engine further comprises where the piston crown divides the chamber into a lower chamber and an upper chamber, wherein an annular passage fluidly couples the lower chamber to the upper chamber.

A second example of the engine, optionally including the first example, further includes where the annular passage is shaped via a gap between interior surfaces of the piston that shape the chamber and surfaces of the piston crown, wherein a size of the gap is equal to a difference in diameters of the piston crown and the chamber.

A third example of the engine, optionally including one or more of the previous examples, further includes where the lower chamber is closer to a connecting rod than the upper chamber.

A fourth example of the engine, optionally including one or more of the previous examples, further includes where the lower chamber is fluidly coupled to a feed line, wherein the feed line extends through a connecting rod to the chamber of the piston.

A fifth example of the engine, optionally including one or more of the previous examples, further includes where the feed line comprises a one-way check valve configured to allow fluid to flow from only the feed line to the chamber.

A sixth example of the engine, optionally including one or more of the previous examples, further includes where a pump is configured to supply fluid to the feed line, wherein a pressure of the pump is set via a signal sent from a controller.

A seventh example of the engine, optionally including one or more of the previous examples, further includes where the controller comprises instructions stored on non-transitory memory thereof that when executed enable the controller to increase a pressure of the fluid in the feed line in response to a temperature of the engine being greater than a threshold temperature, wherein a volume of the lower chamber is greater than a volume of the upper chamber and where the fluid in the lower chamber presses the piston bowl in a first direction away from a connecting rod.

An eighth example of the engine, optionally including one or more of the previous examples, further includes where the instructions further enable the controller to decrease a pressure of the fluid in the feed line in response to the temperature of the engine being less than or equal to the threshold temperature, wherein the volume of the upper chamber is greater than the volume of the lower chamber as the piston bowl moves in a second direction, opposite the first direction, in a direction toward the connecting rod.

An embodiment of a method comprises adjusting a pressure of a fluid flowing into a lower portion of a chamber from a feed line to a pressure greater than a threshold pressure to move a piston bowl of a piston in a first direction to a first position without moving a remainder of the piston and adjusting the pressure of the fluid in the feed line to a pressure less than or equal to the threshold pressure to move the piston bowl in a second direction, opposite the first direction, to a second position without moving the remainder of the piston.

A first example of the method further includes where adjusting the pressure of the fluid to the pressure greater than the threshold pressure occurs outside of a cold-start, wherein the first position corresponds to a lowest compression ratio of a combustion chamber in which the piston is positioned to oscillate, wherein adjusting the pressure of the fluid to the pressure less than or equal to the threshold pressures occurs during the cold-start, wherein the second position corresponds to a highest compression ratio of the combustion chamber.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A system, comprising:

an engine comprising at least one cylinder with a piston positioned to oscillate therein, wherein the piston comprises a piston crown moveable within an interior space of a piston body to a first position and a second position in response to a fluid entering a chamber, and wherein the chamber is fluidly coupled to a feed line and a cooling chamber in each of the first position and the second position of the piston crown.

2. The system of claim 1, wherein the fluid is oil and the engine is a spark-ignited engine.

3. The system of claim 1, wherein the piston crown divides the chamber into a first chamber and a second chamber, wherein a volume of the first chamber is greater than a volume of the second chamber when the piston crown is in the first position.

4. The system of claim 3, wherein a compression ratio of the at least one cylinder is highest when the piston crown is in the first position.

5. The system of claim 4, wherein the volume of the second chamber is greater than the volume of the first chamber when the piston crown is in the second position, wherein the compression ratio of the at least one cylinder is lowest when the piston crown is in the second position.

6. The system of claim 3, wherein the first chamber and the second chamber are fluidly coupled via an annular gap surrounding the piston crown.

7. The system of claim 1, wherein the cooling chamber is arranged radially outward relative to the piston crown proximally to a cylinder liner.

8. The system of claim 1, wherein the feed line comprises a one-way check valve, wherein the one-way check valve allows the fluid to only flow from the feed line to the chamber.

9. The system of claim 1, wherein the piston crown is a piece of the piston separate from the piston body.

10. An engine, comprising:

a plurality of combustion chambers each comprising a piston positioned to oscillate along an axis, the piston further comprising a piston body comprising a chamber divided by a piston crown, into a lower chamber and an upper chamber, wherein the piston crown is positioned to oscillate therein along the axis in response to a pressure of a fluid in the chamber, wherein an annular passage fluidly couples the lower chamber to the upper chamber, wherein the annular passage is free of a valve or other fluid flow control element, wherein the annular passage is shaped via a gap between interior surfaces of the piston body that shape the chamber and outer surfaces of the piston crown, and wherein a size of the gap is equal to a difference in diameters of the piston crown and the interior surfaces of the piston body.

11. The engine of claim 10, wherein the lower chamber is closer to a connecting rod than the upper chamber.

12. The engine of claim 10, wherein the lower chamber is fluidly coupled to a feed line, wherein the feed line extends through a connecting rod to the chamber of the piston.

13. The engine of claim 12, wherein the feed line comprises a one-way check valve configured to allow fluid to flow from only the feed line to the chamber.

14. The engine of claim 12, wherein a pump is configured to supply fluid to the feed line, wherein a pressure of the pump is set via a signal sent from a controller.

15. The engine of claim 14, wherein the controller comprises instructions stored on non-transitory memory thereof that when executed enable the controller to increase a pressure of the fluid in the feed line in response to a knocking risk of the engine being lower than a threshold risk, wherein a volume of the lower chamber is greater than a volume of the upper chamber and where the fluid in the lower chamber presses the piston crown in a first direction away from a connecting rod.

16. The engine of claim 15, wherein the instructions further enable the controller to decrease a pressure of the fluid in the feed line in response to the knocking risk of the engine being higher than or equal to the threshold risk, wherein the volume of the upper chamber is greater than the volume of the lower chamber as the piston crown moves in a second direction, opposite the first direction, in a direction toward the connecting rod.

17. A method, comprising:

adjusting a pressure of a fluid flowing into a lower portion of a chamber from a feed line to a pressure greater than a threshold pressure to move a piston bowl of a piston in a first direction to a first position without moving a remainder of the piston, wherein adjusting the pressure of the fluid to the pressure greater than the threshold pressure occurs outside of a cold-start, wherein the first position corresponds to a highest compression ratio of a combustion chamber in which the piston is positioned to oscillate; and adjusting the pressure of the fluid in the feed line to a pressure less than or equal to the threshold pressure to move the piston bowl in a second direction, opposite the first direction, to a second position without moving the remainder of the piston, wherein adjusting the pressure of the fluid to the pressure less than or equal to the threshold pressures occurs during the cold-start, wherein the second position corresponds to a lowest compression ratio of the combustion chamber.

* * * * *